US006666110B1

(12) United States Patent
Buettner

(10) Patent No.: US 6,666,110 B1
(45) Date of Patent: Dec. 23, 2003

(54) TWIST OFF BOTTLE CAP REMOVER

(76) Inventor: Fred A. Buettner, 150 Cheyenne, Nacogdoches, TX (US) 75964

( * ) Notice: Subject to any disclaimer, the term of this patent is extended or adjusted under 35 U.S.C. 154(b) by 0 days.

(21) Appl. No.: 10/160,449

(22) Filed: May 30, 2002

(51) Int. Cl.[7] ..... B67B 7/14
(52) U.S. Cl. ..... 81/3.4; 81/3.41; 81/3.42; 81/3.43; 81/176.1
(58) Field of Search ..... 81/3.4, 3.41, 3.42, 81/3.43, 176.1, 176.15, 176.2, 486, 487, 120, 121.1

(56) References Cited

U.S. PATENT DOCUMENTS

| | | | | | |
|---|---|---|---|---|---|
| 3,812,741 | A | * | 5/1974 | Heine | 81/3.4 |
| 4,235,132 | A | | 11/1980 | Kendall | |
| 4,633,740 | A | * | 1/1987 | Jacobs | 81/3.09 |
| 4,829,618 | A | * | 5/1989 | McKee | 7/151 |
| 4,911,038 | A | * | 3/1990 | Ferrin | 81/3.09 |
| 4,967,622 | A | * | 11/1990 | Phillips | 81/3.09 |
| D383,953 | S | | 9/1997 | DeFilippo | |
| D390,433 | S | | 2/1998 | Miller | |
| D407,283 | S | * | 3/1999 | Schwab | D8/40 |
| 6,105,468 | A | | 8/2000 | Fohrman et al. | |
| D433,607 | S | | 11/2000 | Park | |
| D440,135 | S | | 4/2001 | Vaught | |

* cited by examiner

*Primary Examiner*—Joseph J. Hail, III
*Assistant Examiner*—Alvin J. Grant
(74) *Attorney, Agent, or Firm*—Jesse D. Lambert

(57) ABSTRACT

Apparatus for twisting off crown bottle caps. A main body in side view is flattened and has a thickness, with a circular opening through the thickness, the opening large enough to accommodate the diameter of a crown bottle cap. The circumferential edge of the opening is formed into a plurality of pairs of facets, each pair of facets forming a notch. The walls of the facets are not parallel to one another but instead taper toward one another and form generally pyramidal shapes which intersect, or come to a point, within the main body thickness. An inverted triangular shape is formed between each pair of facets. A bottle cap is inserted into the opening, where the notches formed by the facets closely engage the bottle cap jags. The contour of the main body then permits the user to readily twist off the bottle cap.

12 Claims, 2 Drawing Sheets

TWIST OFF BOTTLE CAP REMOVER

BACKGROUND

1. Field of Art

This invention relates to apparatus used to open beverage containers, especially bottles having twist off caps. With more specificity, this invention relates to an apparatus that in efficiently removes twist off caps yet can be readily carried on the person of a user, for example on a key ring, for easy accessibility and use. In addition, the invention may be formed in shapes which render it attractive as a novelty item.

2. Related Art

Bottle capping was developed many years ago as a means of sealing the opening of beverage bottles. Long ago, bottle caps generally standardized into a shape called a "crown cap" which has a circumferential skirt around its lower edge. The skirt is formed into a number of projecting flutes called "jags," at least one function of which is to provide some resilience in the skirt to permit it to fit over and tightly seal around the neck of the bottle. Bottle caps have a standard number of 21 jags (except for some large caps which may have 24 jags). Initially, bottle caps had to be pried off of the neck of the bottle with hand held or mounted openers.

More recently, crown bottle caps were developed which could be twisted off of the neck of the bottle, rather than being pried off. Often, the caps can be removed by the average person grasping the cap and twisting it off with the unaided hand. However, at times this mode of removal is either very difficult or inconvenient, and persons resort to prying the cap off. Variations in cap and bottle opening dimensions, the force with which the cap was applied to the bottle neck, etc. make removal uncertain. Additionally, the jags around the bottle cap skirt, while providing improved gripping, can be relatively sharp and painful to the hand.

In response, various apparatus have been made which assist in twisting off bottle caps. Most share the attribute of fitting over and engaging the bottle cap, and providing both improved gripping and leverage to twist the cap off. However, the known prior art shares various deficiencies in the shape of the surfaces of the apparatus which engage the bottle cap.

SUMMARY OF THE INVENTION

The present invention is an apparatus which has an improved crown bottle cap engaging surface, thereby providing improved ability to twist off the bottle cap. The apparatus has an outer profile, when viewed from the top or bottom, which can be readily formed in the shape of items such as a football, thereby making an attractive novelty item. The apparatus may be carried in a user's pocket or on a key chain for ready access. A flattened main body is elongated, and, when viewed from a side, has a given thickness, and has a circular opening into which a crown bottle cap may be inserted. The circumference of the opening is formed into a plurality of pairs of facets, each of the facets having walls which are not parallel to each other (that is, straight-sided), but instead taper toward one another and intersect within the thickness of the main body. Each pair of facets form a notch, and in the preferred embodiment of the invention the number of notches matches the number of jags on a standard crown bottle cap, generally 21 in number. The elongated shape of the apparatus provides improved gripping and twisting off of the bottle cap, and permits the invention, when viewed from the top or bottom, to be formed into desirable and attractive shapes, enhancing its appeal as a novelty item.

DESCRIPTION OF THE PRESENTLY PREFERRED EMBODIMENT

While the invention may be made in various shapes, with respect to the drawings one presently preferred embodiment is now described.

Figure 1:
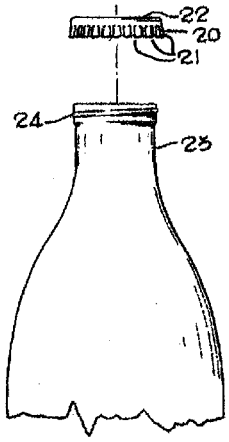
FIG. 1 is a side view of a representative bottle and bottle cap.

FIG. 1, as reference, shows a typical bottle 23 having an opening with an upper neck 24. Bottle cap 22 has a skirt 20, with a plurality of jags 21 about its circumference.

Figure 4:
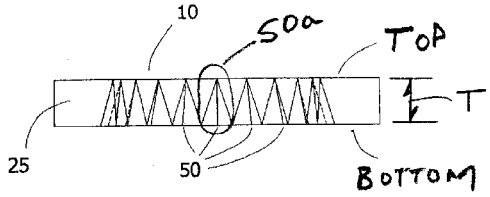
FIG. 4 is a side view in cross section of the opener, along an axis generally perpendicular to A–A'.
Figure 2:
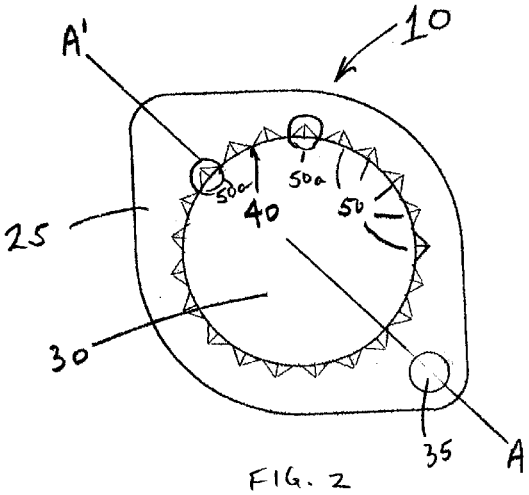
FIG. 2 is a bottom view of one presently preferred embodiment of the opener of the present invention.
Figure 3:
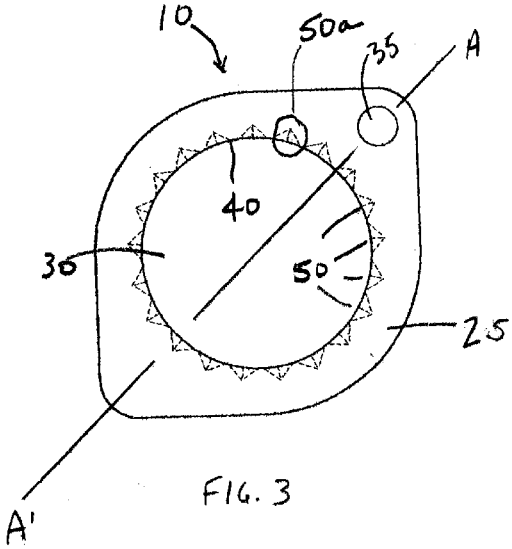
FIG. 3 is a top view of the opener.

Referring to FIGS. 2–4, FIG. 2 shows a view from the bottom of the apparatus 10. Main body 25 is elongated (as shown along axis A–A') with a thickness T (as noted in FIG. 4) and has a circular opening 30 with a diameter sized to engage a twist off bottle cap. Edge 40 of opening 30 is circumferentially ringed with a plurality of pairs of opposing facets 50, which are adapted to securely engage the jags on a twist off bottle cap. The walls of facets 50 are not parallel to one another, but instead slope inwardly toward one another, and intersect one another within the thickness T of main body 25. As can best be seen in FIG. 4, an inverted triangular shape is formed between each pair of facets 50. The shape resulting from each pair of facets 50 is a plurality of notches 50*a* into which jags 21 closely mesh when circular opening 30 of the apparatus is placed over a bottle cap 22. Notches 50*a* are noted on the figures as the circled elements; for clarity, not all of notches 50*a* are circled, but it is understood that all like notches are included in the reference to element 50*a*. FIG. 4 is a side view in cross section, along an axis generally perpendicular to axis A–A'. While in the pictured embodiment, main body 25 is generally flattened, in the sense that the dimension along axis A–A' (or the axis perpendicular thereto), is greater than thickness T, and is illustrated as rectangular, it is understood that various cross-sectional shapes other than the rectangular cross section could be used, such as those with rounded corners, or forming an oval or ellipse, could also be used.

In the presently preferred embodiments, the number of notches formed by the pairs of facets 50 is equal in number to the number of jags on a crown bottle cap, typically 21. However, it is understood that a fewer number of notches could be formed edge 40, while still providing sufficient notches to securely engage jags 21.

As seen in FIGS. 2 and 3, the outer profile of main body 25, when viewed from the top or the bottom, is elongated in one direction, here represented by axis A–A'. This shape gives the user additional leverage to twist the bottle cap off. A means for attaching the apparatus to a key ring or the like may be provided. In one preferred embodiment, said means for attaching comprises a second opening or hole 35 provided in main body 25. Other means for attaching include a small eye attached to the main body, or other means known in the art.

Figure 5:
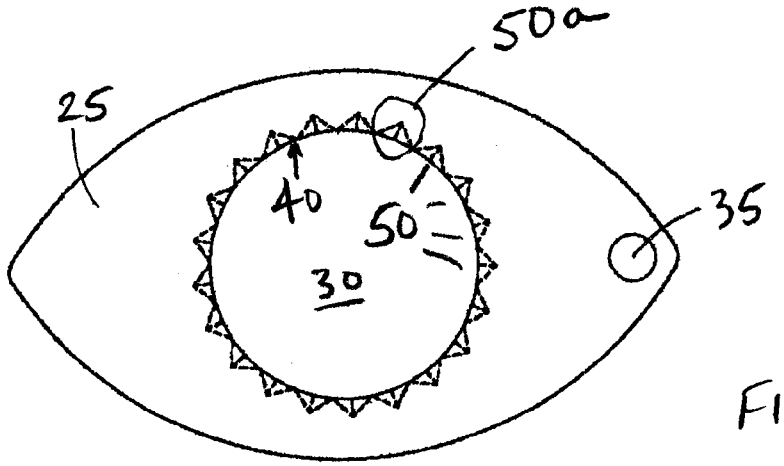
FIGS. 5 and 6 are top and bottom views, respectively, of an alternative embodiment of the present invention.
Figure 6:
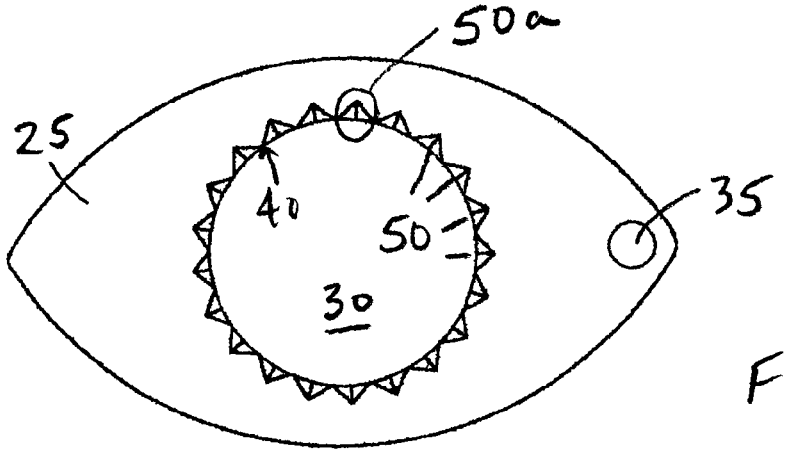

Alternate embodiments of the invention can have different shapes of the profile (from the top or bottom) of main body 25. FIGS. 5 and 6 show top and bottom views, respectively, of a main body profile which more closely resembles the profile of a football. In addition to the shape, color and texture could be added to further heighten the resemblance to a football. In like manner, other objects of a generally elongated shape could be modeled.

Various materials can be used to make the opener. Aluminum yields a strong yet light weight opener, and is very satisfactory, but it is understood that other metals, plastics of different sorts, and even wood could be used. The outer profile, opening, and facets can be cut by milling, machining, or other means well known in the art.

While the description herein gives many details of the present invention, it is understood that same are given to illustrate some of the presently preferred embodiments of the invention and not in a limiting sense. The outer profile of the main body could be made in different shapes; different colors, textures, and patterns could be added to the main body to simulate different objects, such as sports balls and the like; and different materials could be used to make the opener, such as other metals, plastics, or wood. A different number of notches, including a number fewer than the number of jags on a typical crown bottle cap, could be used.

Therefore, the scope of the invention is to be limited only by the scope of the appended claims and their legal equivalents.

I claim:

1. An apparatus for removing twist off bottle caps, comprising:

a main body, in side view being generally flattened and having a top and a bottom defining a thickness, said main body having a circular opening therein, the edge of said opening being formed into a plurality of pairs of facets, each of said plurality of pairs of facets having side walls which taper toward each other from said bottom to said top and intersect each other within said thickness of said main body, forming a notch which is adapted to closely engage the jags of a bottle cap.

2. The apparatus of claim 1, wherein a shape of said main body when viewed from the top or bottom is that of the profile of a football.

3. The twist off bottle cap remover of claim 1, wherein said main body further comprises a means for attaching said apparatus to a key ring.

4. The apparatus of claim 3, wherein said means for attaching comprises a hole through said main body.

5. The apparatus of claim 3, wherein said means for attaching comprises an eye attached to said main body.

6. The apparatus of claim 1, wherein the number of notches is equal to the number of jags on said bottle cap.

7. The apparatus of claim 1, wherein the number of notches is 21.

8. An apparatus for removing twist off bottle caps, comprising:

a main body, in side view having a rectangular shape with a thickness, said main body having a circular opening through said thickness, the edge of said opening being formed into a plurality of pairs of facets, each of said plurality of pairs of facets having side walls which taper toward each other in a direction from a bottom to a top of said main body and intersect each other within said thickness of said main body, forming a notch which is adapted to closely engage the jags of a bottle cap; and wherein an outer profile of said main body, when viewed from the top or bottom, is elongated in one direction.

9. The twist off cap remover of claim 8, wherein said outer profile of said main body, when viewed from the top or bottom, is formed into the likeness of a football.

10. The apparatus of claim 8, wherein the number of notches is equal to the number of jags on said bottle cap.

11. The apparatus of claim 8, wherein the number of notches is 21.

12. The apparatus of claim 1, wherein an outer profile of said main body, when viewed from the top or bottom, is elongated in one direction.

* * * * *